US006653988B2

(12) United States Patent
Kwon et al.

(10) Patent No.: US 6,653,988 B2
(45) Date of Patent: Nov. 25, 2003

(54) PARALLEL RESONANCE WHIRL ANTENNA

(75) Inventors: Gi Chung Kwon, Kyunggi-do (KR); Hong Sik Byun, Songnam-shi (KR); Sung Weon Lee, Yongin-shi (KR); Hong Seub Kim, Yongin-shi (KR); Sun Seok Han, Suwon-shi (KR); Bu Jin Ko, Taejon (KR); Joung Sik Kim, Chungcheongnam-do (KR)

(73) Assignee: Jusung Engineering, Co., LTD (KR)

( * ) Notice: Subject to any disclaimer, the term of this patent is extended or adjusted under 35 U.S.C. 154(b) by 0 days.

(21) Appl. No.: 10/185,676

(22) Filed: Jun. 27, 2002

(65) Prior Publication Data

US 2003/0001792 A1 Jan. 2, 2003

(30) Foreign Application Priority Data

Jun. 27, 2001 (KR) ..... 2001-36917

(51) Int. Cl.[7] ..... H01Q 1/36; H01J 7/24

(52) U.S. Cl. ..... 343/895; 315/111.51; 156/345.48; 118/723 AN

(58) Field of Search ..... 343/895, 741, 343/742, 866, 867; 315/111.21, 111.51; 156/345.48; 118/723 I, 723 AN

(56) References Cited

U.S. PATENT DOCUMENTS 5,683,539 A 11/1997 Qian et al. ..... 156/345
5,907,221 A 5/1999 Sato et al. ..... 315/111.51
6,447,635 B1 * 9/2002 Ra ..... 156/345.48

* cited by examiner

*Primary Examiner*—Hoang Nguyen
(74) *Attorney, Agent, or Firm*—Marger, Johnson & McCollom, P.C.

(57) ABSTRACT

Disclosed is a parallel resonance antenna comprising: a whirl antenna having a plurality of antenna units installed two-dimensionally and radially around a central point, each of the antenna units having a ground point at a predetermined position thereof, portions outside the ground points respectively being bent in a same direction, the antenna units having a same size and direction, angles between the antenna units at the central point being all the same; a central conductive line connected to the central point to be normal to the whirl antenna, for being supplied with an RF power; a metal plate installed over and apart from the whirl antenna, the metal plate being connected with end portions of the antenna units, and having a penetration hole through which the central conductive line passes without contacting with the metal plate; and a variable resonance capacitor installed in series between the central conductive line and the metal plate. According to a parallel resonance antenna, the geometrical structure enables to obtain a uniform plasma. Since the antenna has a small inductance, impedance matching is easy even at the VHF band. Also, at the resonance point, since the potential of the inner portions (Z1, Z2, Z3 and Z4) of the ground points of the antenna units is low, it becomes possible to decrease a non-desired sputtering phenomenon.

8 Claims, 4 Drawing Sheets

PARALLEL RESONANCE WHIRL ANTENNA

BACKGROUND OF THE INVENTION

1. Field of the Invention

The present invention relates to a parallel resonance whirl antenna, and more particularly, to a parallel resonance antenna (or parallel resonance whishler antenna) capable of uniformly transferring an RF power of very high frequency (VHF) band.

2. Description of the Related Art

In semiconductor device manufacturing processes, processes using plasma are frequently performed. Dry etching, chemical vapor deposition (CVD) and sputtering are examples of such processes. In order to enhance the process efficiency, a process using a high density plasma (HDP) having an ion concentration of approximately $1\times10^{11}$–$2\times10^{12}$ ions/cm$^3$ is frequently employed at the present. It is well known that this high density plasma can be obtained by inductively coupled plasma (ICP).

To obtain the aforementioned high density inductively coupled plasma, many applications using the parallel resonance antenna have been tried, but it is not easy to obtain a plasma having a uniform density. Especially, it is much more difficult to obtain such a uniform plasma in the VHF band. The VHF band corresponds to a frequency band between 20 MHz and 300 MHz.

SUMMARY OF THE INVENTION

Accordingly, it is a technical object of the invention to provide a parallel resonance antenna having a new structure and capable of uniformly transferring an RF power of the VHF band.

To accomplish the above object, there is provided a parallel resonance antenna comprising: a whirl antenna having a plurality of antenna units installed two-dimensionally and radially around a central point, each of the antenna units having a ground point at a predetermined position thereof, portions outside the ground points respectively being bent in a same direction, the antenna units having a same size and direction, angles between the antenna units at the central point being all the same; a central conductive line connected to the central point to be normal to the whirl antenna, for being supplied with an RF power; a metal plate installed over and apart from the whirl antenna, the metal plate being connected with end portions of the antenna units, and having a penetration hole through which the central conductive line passes without contacting with the metal plate; and a variable resonance capacitor installed in series between the central conductive line and the metal plate.

The antenna units are made of copper. Preferably, the bent portions of the antenna units have an arc shape with the central point as a center point, and an inner portion of the ground point has a convex shape in the bent direction.

Also, the central conductive line, the antenna units and the metal plate have vacant inner spaces such that a cooling water supplied through the central conductive line is discharged via the antenna unit and the metal plate to an outside, the central conductive line, the antenna units and the metal plate being connected with each other such that the inner spaces thereof communicate with each other, and a cooling water discharge hole being furnished near the penetration hole of the metal plate.

Preferably, the antenna unit placed inside the ground point is longer than the antenna unit placed outside the ground point, or the antenna unit placed inside the ground point is the same in length as the antenna unit placed outside the ground point.

The metal plate is directly connected with the antenna units, to have an upward convex shape. Also, the antenna may further comprise an external conductive line vertically installed with the whirl antenna at the ends of the antenna units, and the metal plate is connection-supported to have a flat shape. In the latter case, the central conductive line, the antenna units and the metal plate have vacant inner spaces such that a cooling water supplied through the central conductive line is discharged via the antenna unit and the metal plate to an outside, the central conductive line, the antenna units and the metal plate being connected with each other such that the inner spaces thereof communicate with each other, and a cooling water discharge hole being furnished near the penetration hole of the metal plate.

BRIEF DESCRIPTION OF THE DRAWINGS

The above object and other advantages of the present invention will become more apparent by describing in detail preferred embodiments thereof with reference to the accompanying drawings in which.

DETAILED DESCRIPTION OF THE PREFERRED EMBODIMENT

Now, preferred embodiments of the present invention will be described in detail with reference to the accompanying drawings.

Figure 1A:
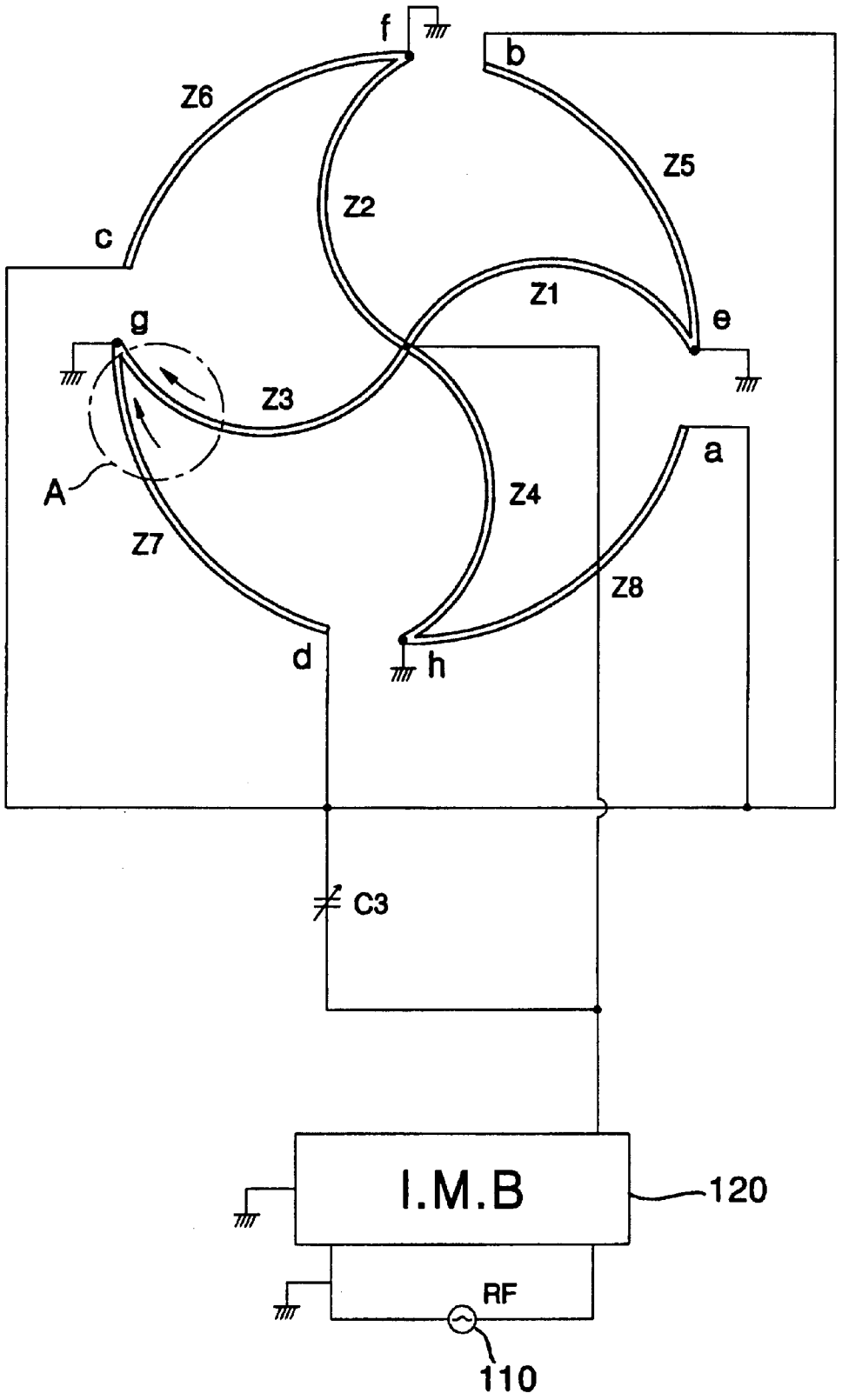
FIG. 1*a* is a schematic view for illustrating a parallel resonance whirl antenna in accordance with the present invention.
Figure 1B:
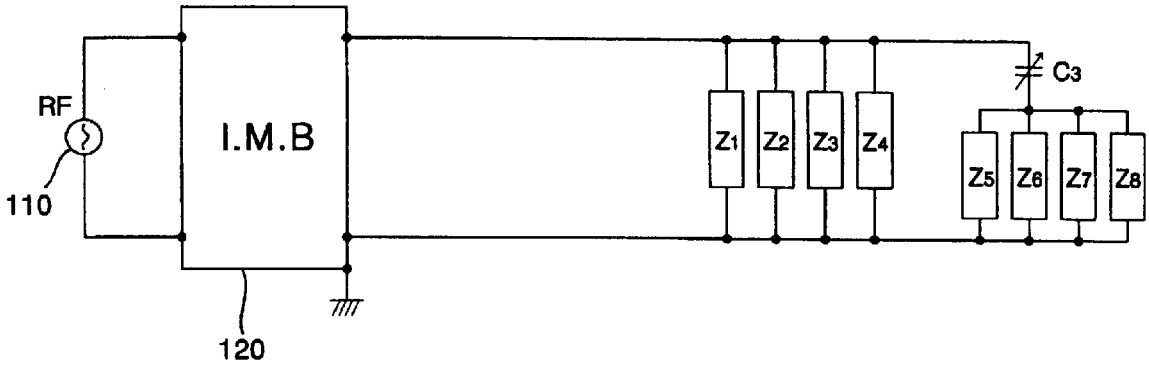
FIG. 1*b* is an equivalent circuit of FIG. 1*a;*

FIG. 1*a* is a schematic view for illustrating a parallel resonance whirl antenna in accordance with the present invention, and FIG. 1*b* is an equivalent circuit of FIG. 1*a.*

Referring to FIGS. 1*a* and 1*b,* a plurality of antenna units are two-dimensionally and radially installed around a point "O" (hereinafter referred to as a central point). The antenna units have ground points (e, f, g and h) at the same positions, and outer portions of the ground points in the antenna units are bent in the same direction. Accordingly, the antenna units seem to be a whirl on the whole. Reference symbols Z1 to Z8 are indicative of corresponding portions of the antenna units, and also indicative of impedance values of the portions.

An RF power source 110 is connected to the central point "O" and ends (a, b, c and d) of the antenna units. Between the RF power 110 and the ends (a, b, c and d) of the antenna units is installed a variable capacitor C3 that is common to the respective antenna units. Between the RF power 110 and the parallel resonance antenna is installed an impedance matching box (IMB) 120 for matching impedance.

The RF power supplied from the RF power source 110 is supplied in parallel to the inner portions Z1, Z2, Z3 and Z4 of the ground points via the central point "O", and is also supplied in parallel to the outer portions Z5, Z6, Z7 and Z8 of the ground points via the variable resonance capacitor C3.

In order to obtain a uniform plasma density, it is preferable that the antenna units have the same size and shape such that the following conditions, i.e., Z1=Z2=Z3=Z4, and Z5=Z6=Z7=Z8, are satisfied. Also, it is preferable that angles between the antenna units at the central point "O" are the same such that the antenna units are geometrically symmetric.

It is desirous that the ground points (a, b, c and d) have a softly curved shape rather than a sharp shape. This is because electric field becomes locally strong at the sharp point, so that it may affect on the uniformity of the plasma.

As indicated by the reference symbol "A", since the current flow near the ground points has the same direction almost, induced magnetic field at this point is not destroyed but causes the constructive interference. Accordingly, it becomes possible to form plasma having the uniform density.

Embodiment 1

Figure 2A:
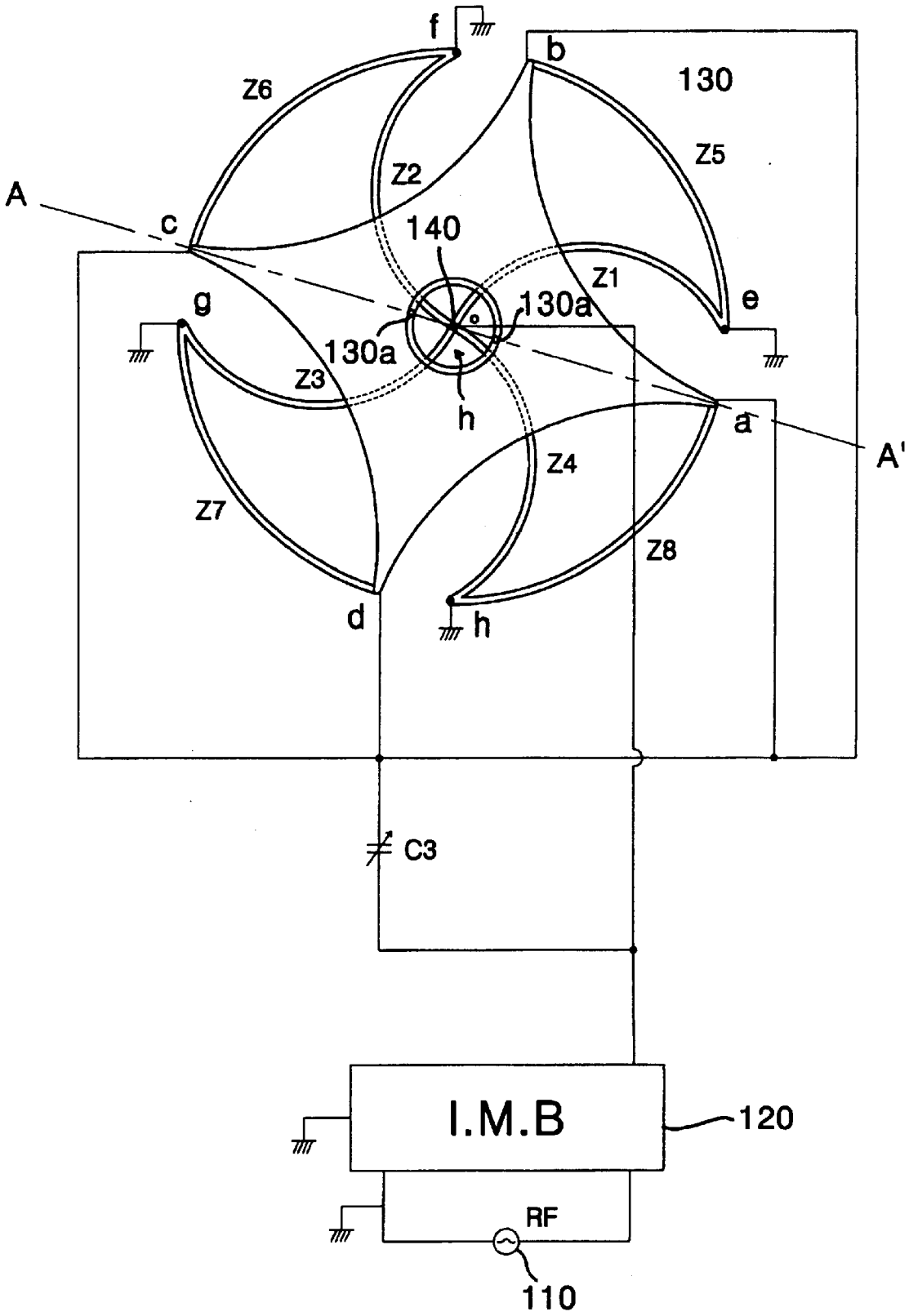
FIG. 2*a* is a plan view for illustrating a parallel resonance whirl antenna in accordance with a first embodiment of the present invention.
Figure 2B:
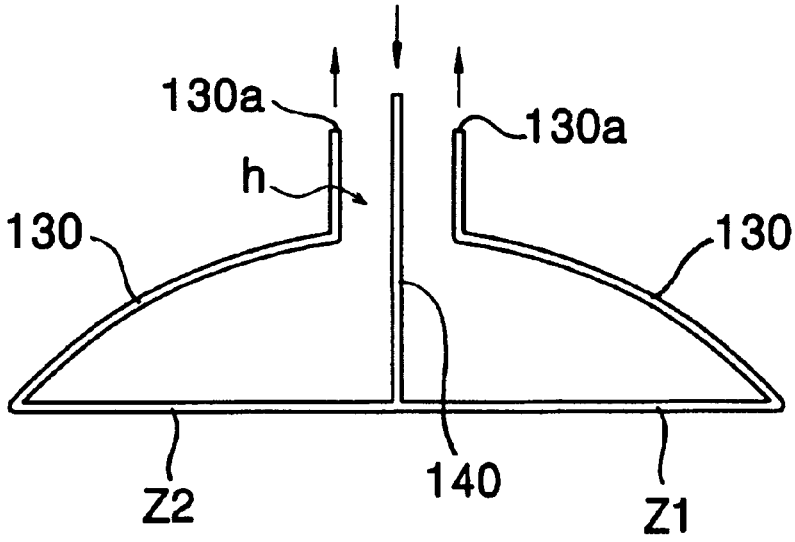
FIG. 2*b* is a sectional view taken along the line A–A' of FIG. 2*b.

FIG. 2*a* is a plan view for illustrating a parallel resonance whirl antenna in accordance with a first embodiment of the present invention, and FIG. 2*b* is a sectional view taken along the line A–A' of FIG. 2*b*. In the drawings of FIGS. 2*a* and 2*b*, it is noted that identical reference numerals with those assigned to the elements of FIG. 1*a* represent elements performing the same functions and their repeated descriptions are intentionally omitted.

Referring to FIGS. 2*a* and 2*b*, a central conductive line 140 is installed at a central point "O" to be normal to the whirl antenna. A metal plate 130 is installed over and apart from the whirl antenna, and is connected with ends (a, b, c and d) of antenna units to have a convex shape. A penetration hole (h) is formed at the center of the metal plate 130 such that the central conductive line 140 passes without contacting with the metal plate 130. Although not shown in the drawings, a variable resonance capacitor (C3 of FIG. 1*a*) is installed such that it is serially connected between the central conductive line 140 and the metal plate 130.

If an RF power is applied to the central conductive line 140 from an RF power source 110, a part of the RF power flows through ground points (e, f, g and h) via inner portions (Z1, Z2, Z3 and Z4) of the ground points, and a remaining part of the RF power flows through the ground points (e, f, g and h) via the variable resonance capacitor, the metal plate 130 and the outer portions (Z5, Z6, Z7 and Z8) of the ground points in the order named.

Resonance frequency can be expressed by an equation of $(LC)^{-1/2}$. Here, inductance L is decided by the geometrical structure of the antenna, to have a fixed value. To this end, in the VHF band having the frequency range of 20 MHz–300 MHz, a small capacitance value permits occurrence of resonance. Accordingly, a vacuum variable capacitor can be used as the variable resonance capacitor C3, but it is much preferable to use a coaxial capacitor capable of securing a small capacitance of 1–5 pF and finely controlling the capacitance value, as the variable resonance capacitor C3.

The antenna units can be made of substance having the conductivity, and copper is mainly used. The antenna units have the ground points (e, f, g and h) at the same positions, and the outer portions of the ground points (e, f, g and h) are bent in the same direction. The outer portions of the ground points (e, f, g and h), i.e., the bent portions (Z5, Z6, Z7 and Z8) have an arc shape around the central point "O", and the inner portions (Z1, Z2, Z3 and Z4) of the ground points have a convex shape along the bent direction, so that the antenna units have a whirl shape on the whole. It is preferable that the inner portions (Z1, Z2, Z3 and Z4) of the ground points of the antenna units are longer than the outer portions (Z5, Z6, Z7 and Z8) of the ground points of the antenna units, or the inner portions (Z1, Z2, Z3 and Z4) of the ground points of the antenna units are the same in length as the outer portions (Z5, Z6, Z7 and Z8) of the ground points of the antenna units. The inner portions (Z1, Z2, Z3 and Z4) of the ground points may have a several times-bent arc shape.

The central conductive line 140, the antenna units and the metal plate 130 have vacant inner spaces, and they are connected such that the inner spaces communicate with each other. A cooling water discharge hole 130*a* is furnished near the penetration hole (h) of the metal plate 130. Accordingly, if cooling water is supplied through the central conductive line 140, the cooling water is discharged via the central conductive line 140, the antenna units, the metal plate 130 sequentially through the cooling water discharge hole 130*a* to an outside.

Embodiment 2

Figure 3:
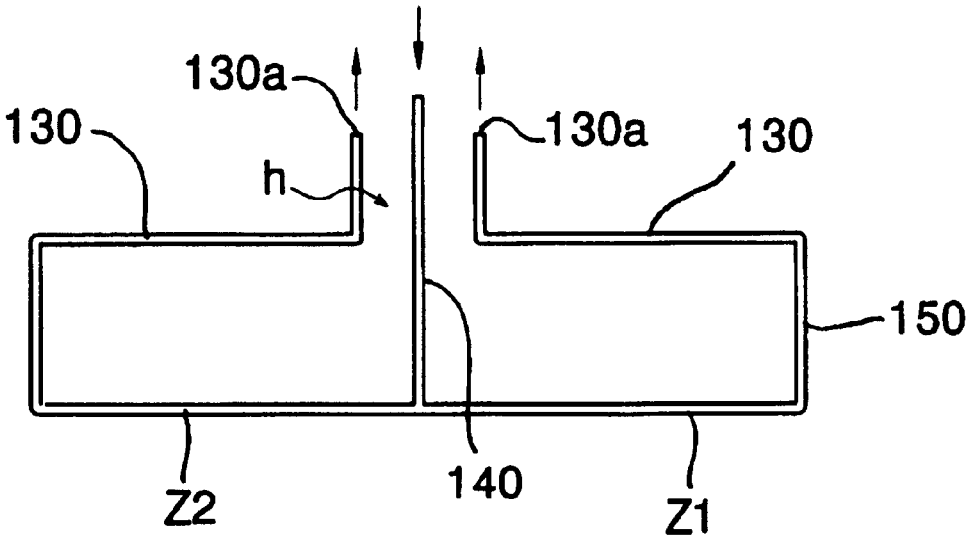
* and FIG. 3 is a sectional view for illustrating a parallel resonance whirl antenna in accordance with a second embodiment of the present invention.

FIG. 3 is a sectional view for illustrating a parallel resonance whirl antenna in accordance with a second embodiment of the present invention. The structure of FIG. 3 has a difference from those of FIGS. 2*a* and 2*b*. In other words, external conductive lines 150 are respectively installed at the ends (a, b, c and d) of the respective antenna units such that it is normal to the whirl antenna, and the metal plate 130 is connected and supported to have a flat shape.

In this case, for the flow of cooling water, the external conductive line 150 has an vacant inner space, and the external conductive line 150 is connected with the metal plate 130 and the ends (a, b, c and d) of the respective antenna units such that their inner spaces communicate with each other. Accordingly, the cooling water supplied through the central conductive line 140 is discharged to the outside via the antenna units, the external conductive lines 150 and the metal plate 130 sequentially.

As described previously, according to a parallel resonance antenna, the geometrical structure enables to obtain a uniform plasma. Since the antenna has a small inductance, impedance matching is easy even at the VHF band. Also, at the resonance point, since the potential of the inner portions (Z1, Z2, Z3 and Z4) of the ground points of the antenna units is low, it becomes possible to decrease a non-desired sputtering phenomenon.

Although the preferred embodiments of the present invention have been disclosed for illustrative purposes, those skilled in the art will appreciate that various modifications, additions and substitutions can be made without departing from the scope and spirit of the invention as disclosed in the accompanying claims.

What is claimed is:

1. A parallel resonance antenna comprising:

a whirl antenna having a plurality of antenna units installed two-dimensionally and radially around a central point, each of the antenna units having a ground point at a predetermined position thereof, portions outside the ground points respectively being bent in a same direction, the antenna units having a same size and direction, angles between the antenna units at the central point being all the same;

a central conductive line connected to the central point to be normal to the whirl antenna, for being supplied with an RF power;

a metal plate installed over and apart from the whirl antenna, the metal plate being connected with end portions of the antenna units, and having a penetration hole through which the central conductive line passes without contacting with the metal plate; and a variable resonance capacitor installed in series between the central conductive line and the metal plate.

2. The parallel resonance antenna as claimed in claim 1, wherein the antenna units are made of copper.

3. The parallel resonance antenna as claimed in claim 1, wherein the bent portions of the antenna units have an arc shape with the central point as a center point, and an inner portion of the ground point has a convex shape in the bent direction.

4. The parallel resonance antenna as claimed in claim 1, wherein the central conductive line, the antenna units and the metal plate have vacant inner spaces such that a cooling water supplied through the central conductive line is discharged via the antenna units and the metal plate to an outside, the central conductive line, the antenna units and the metal plate being connected with each other such that the inner spaces communicate with each other, and a cooling water discharge hole being furnished near the penetration hole of the metal plate.

5. The parallel resonance antenna as claimed in claim 1, wherein the antenna unit placed inside the ground point is longer than the antenna unit placed outside the ground point, or the antenna unit placed inside the ground point is the same in length as the antenna unit placed outside the ground point.

6. The parallel resonance antenna as claimed in claim 1, wherein the metal plate is directly connected with the antenna units, to have an upward convex shape.

7. The parallel resonance antenna as claimed in claim 6, further comprising an external conductive line vertically installed with the whirl antenna at the ends of the antenna units, and the metal plate is connection-supported to have a flat shape.

8. The parallel resonance antenna as claimed in claim 7, wherein the central conductive line, the antenna units and the metal plate have vacant inner spaces such that a cooling water supplied through the central conductive line is discharged via the antenna units and the metal plate to an outside, the central conductive line, the antenna units and the metal plate being connected with each other such that the inner spaces communicate with each other, and a cooling water discharge hole being furnished near the penetration hole of the metal plate.

* * * * *